US011085468B2

(12) United States Patent
Tamura

(10) Patent No.: US 11,085,468 B2
(45) Date of Patent: Aug. 10, 2021

(54) HYDRAULIC CYLINDER

(71) Applicant: SMC CORPORATION, Chiyoda-ku (JP)

(72) Inventor: Ken Tamura, Noda (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/645,371

(22) PCT Filed: Jul. 6, 2018

(86) PCT No.: PCT/JP2018/025732
§ 371 (c)(1),
(2) Date: Mar. 6, 2020

(87) PCT Pub. No.: WO2019/049500
PCT Pub. Date: Mar. 14, 2019

(65) Prior Publication Data

US 2020/0300276 A1 Sep. 24, 2020

(30) Foreign Application Priority Data

Sep. 7, 2017 (JP) ..... JP2017-172250

(51) Int. Cl.
*F15B 15/28* (2006.01)
*F15B 15/14* (2006.01)

(52) U.S. Cl.
CPC ..... *F15B 15/2861* (2013.01); *F15B 15/1423* (2013.01); *F15B 15/1471* (2013.01)

(58) Field of Classification Search
CPC ..... F15B 15/1423; F15B 15/1471; F15B 15/2861
See application file for complete search history.

(56) References Cited

U.S. PATENT DOCUMENTS 5,813,313 A * 9/1998 Stoll ..... F15B 15/2807 92/244
7,557,568 B2 * 7/2009 Terasaki ..... F15B 15/2861 324/207.24
10,570,934 B2 * 2/2020 Kudo ..... F15B 15/1419
10,718,360 B2 * 7/2020 Odaka ..... F15B 15/14
(Continued)

FOREIGN PATENT DOCUMENTS

CN 1212337 A 3/1999
DE 10 2009 020 2 11/2010
(Continued)

OTHER PUBLICATIONS

International Search Report dated Oct. 9, 2018 in PCT/JP2018/025732 filed Jul. 6, 2018, 2 pages.
(Continued)

*Primary Examiner* — Michael Leslie
(74) *Attorney, Agent, or Firm* — Oblon, McClelland, Maier & Neustadt, L.L.P.

(57) ABSTRACT

A hydraulic cylinder is provided with a cylinder tube, a piston unit, and a piston rod. The piston unit has a piston body; packing mounted on the piston body; a holding member mounted on the piston body; and a magnet held by a magnet holding part of the holding member. The magnet holding part has a notch that is open on the outer circumferential surface of the holding member.

8 Claims, 7 Drawing Sheets

(56) References Cited

U.S. PATENT DOCUMENTS

| | | | | |
|---|---|---|---|---|
| 2008/0173169 | A1 | 7/2008 | Ikari | |
| 2018/0135662 | A1 | 5/2018 | Suzuki et al. | |
| 2019/0170168 | A1* | 6/2019 | Odaka | F15B 15/2861 |
| 2020/0248728 | A1* | 8/2020 | Tamura | F15B 15/14 |

FOREIGN PATENT DOCUMENTS

| | | | |
|---|---|---|---|
| JP | 51-81272 | A | 7/1976 |
| JP | 8-121404 | A | 5/1996 |
| JP | 11-132204 | A | 5/1999 |
| JP | 2001-234903 | A | 8/2001 |
| JP | 2008-133920 | A | 6/2008 |
| JP | 2017-3023 | A | 1/2017 |
| KR | 10-2013-0127375 | | 11/2013 |
| SE | 443 615 | | 3/1986 |
| TW | I547658 | B | 9/2016 |

OTHER PUBLICATIONS

Taiwanese Office Action dated Mar. 29, 2019 in Taiwan Patent Application No. 107124516, 8 pages (with partial English translation).

Office Action dated Mar. 25, 2021 issued in corresponding Korean Patent application No. 10-2020-7009970 (with English translation).

Extended Search Report dated Apr. 16, 2021 in Europe Patent Application No. 18853381.4-1012/3680494 PCT/JP2018025732; 9 pgs.

Office Action dated Mar. 25, 2021 in Korea Patent Application No. 10-2020-7009970 (with English translation); 10 pgs.

Office Action dated May 28, 2021 issued in corresponding Chinese patent application No. 201880057846.5 (with English Translation).

* cited by examiner

10

10

HYDRAULIC CYLINDER

TECHNICAL FIELD

The present invention relates to fluid pressure cylinders (hydraulic cylinders) including pistons on which magnets are disposed.

BACKGROUND ART

For example, fluid pressure cylinders including pistons displaced according to supply of pressurized fluid are well known as means for carrying workpieces and the like (actuators). A typical fluid pressure cylinder includes a cylinder tube, a piston disposed inside the cylinder tube to be movable in the axial direction, and a piston rod connected to the piston.

In a fluid pressure cylinder disclosed in Japanese Laid-Open Patent Publication No. 2008-133920, a ring-shaped magnet is attached to an outer circumferential part of a piston, and a magnetic sensor is disposed outside a cylinder tube to detect the position of the piston. In this structure, the magnet has a ring shape (extends around the entire circumference) while the magnetic sensor is disposed on the cylinder tube only at a point in the circumferential direction. That is, the magnet is larger than necessary to detect the position of the piston. On the other hand, a fluid pressure cylinder disclosed in Japanese Laid-Open Patent Publication No. 2017-003023 includes magnets (non-ring-shaped magnets) held in an outer circumferential part of a piston only at certain points in the circumferential direction.

SUMMARY OF INVENTION

Pistons to which magnets are attached tend to have larger axial dimensions than pistons to which magnets are not attached. As the axial dimensions of the pistons increase, the total lengths of fluid pressure cylinders increase accordingly.

In the fluid pressure cylinder disclosed in Japanese Laid-Open Patent Publication No. 2017-003023, the distances between magnetic sensors and the magnets (positional relationships in the circumferential direction) are constant at all times. Thus, the magnetic force exerted on the magnetic sensors secured at fixed positions (positional relationships between the magnetic sensors and the magnets in the circumferential direction) cannot be adjusted.

On the other hand, a magnetic sensor can be attached to an outer circumferential part of a circular cylinder tube using a sensor mounting band. In this structure, the magnetic sensor can be disposed at a freely selected position on the outer circumferential part of the cylinder tube and thus can be attached after the distance between the magnetic sensor and the non-ring-shaped magnet is adjusted. However, when the piston rod is rotated after the magnetic sensor is attached to the outer circumferential part of the cylinder tube, the distance between the magnetic sensor and the non-ring-shaped magnet is unfavorably changed.

Moreover, when the piston rod is rotated in the structure where the magnetic sensors are attached at fixed positions outside the cylinder tube, the distances between the magnetic sensors and the non-ring-shaped magnets are unfavorably changed.

The present invention has the object of providing a fluid pressure cylinder capable of solving at least one of the aforementioned problems with the known technologies.

To achieve the above-described object, a fluid pressure cylinder of the present invention comprises a cylinder tube including a slide hole inside the cylinder tube, a piston unit disposed to be reciprocable along the slide hole, and a piston rod protruding from the piston unit in an axial direction, wherein the piston unit includes a piston body protruding radially outward from the piston rod, a packing attached to an outer circumferential part of the piston body, a holding member attached to the outer circumferential part of the piston body and including a magnet holding portion, and a magnet held by the magnet holding portion and disposed partially in a circumferential direction of the piston body, and wherein the magnet holding portion has a cavity opened in an outer circumferential surface of the holding member.

According to the fluid pressure cylinder with the above-described structure, the magnet is disposed only at a required point in the circumferential direction, leading to a reduction in the weight of the product. Moreover, since the magnet holding portion has the cavity opened in the outer circumferential surface of the holding member, the magnet can be disposed at a position adjacent to the inner circumferential surface of the cylinder tube. As the distance between the magnetic sensor attached to the outside of the cylinder tube and the magnet disposed inside the cylinder tube can be reduced, the magnetic force required for the magnet can be reduced. This allows the axial thickness of the magnet to be reduced. Consequently, the axial dimension of the piston body can be reduced, leading to a reduction in the total length of the fluid pressure cylinder.

It is preferable that an outer end of the magnet be disposed at the cavity.

According to the structure, the magnet can be disposed even closer to the inner circumferential surface of the cylinder tube, resulting in an effective reduction in the axial thickness of the magnet.

It is preferable that the holding member include a circumferential portion extending in the circumferential direction along the outer circumferential part of the piston body, that the magnet holding portion protrude inward from an inner circumferential surface of the circumferential portion, and that the cavity be opened in an outer circumferential surface of the circumferential portion.

According to the structure, the axial dimension of the holding member can be reduced, resulting in a further reduction in the axial dimension of the piston body.

It is preferable that the magnet holding portion be formed within an axial dimension of the circumferential portion.

According to the structure, the axial dimension of the holding member can be reduced more effectively.

It is preferable that the holding member be provided with, at a position offset from the magnet holding portion in the circumferential direction, a detent protrusion configured to prevent the holding member from rotating with respect to the cylinder tube.

According to the structure, the length of the detent protrusion can be easily ensured to allow the detent protrusion to function as a detent in a preferred manner.

It is preferable that the slide hole and the piston body be circular, that the holding member be rotatable relative to the piston rod, that the piston rod be rotatable relative to the cylinder tube, and that rotation of the holding member relative to the cylinder tube be restricted.

With this, when the cylinder tube is rotated in a structure where a magnetic sensor is attached at a fixed position outside the cylinder tube and the circumferential position of the cylinder tube can be adjusted, the magnet held by the holding member disposed inside the cylinder tube also rotates in an integrated manner. Thus, the magnetic force exerted on the magnetic sensor can be easily adjusted by adjusting the distance between the magnetic sensor disposed outside the cylinder tube and the magnet (positional relationship between the magnetic sensor and the magnet in the circumferential direction). Consequently, various types of magnetic sensors with different sensitivities can be used without changing the cylinder structure. Alternatively, the piston rod can be rotated without affecting the distance between the magnetic sensor and the magnet.

It is preferable that a detent groove extending in an axial direction of the cylinder tube be provided in the inner circumferential surface of the cylinder tube and that the holding member be provided with a detent protrusion fitted in the detent groove.

This simple structure enables the rotation of the holding member and the cylinder tube relative to each other to be restricted.

It is preferable that a projection that is inserted into the detent groove and is in contact with an inner surface of the detent groove to be slidable be disposed on an outer circumferential part of the packing.

According to the structure, sealing performance at the area of the detent groove can be enhanced in a preferred manner.

It is preferable that the piston body be rotatable relative to the piston rod.

According to the structure, the projection of the packing is prevented from being detached from the detent groove, so that the sealing performance of the packing can be maintained in a preferred manner.

It is preferable that the holding member be a wear ring configured to prevent the piston body from coming into contact with the cylinder tube.

Thus, the holding member serves both as the wear ring and a member holding the magnet, leading to simplification of the structure.

In accordance with the fluid pressure cylinder according to the present invention, the axial dimension of the piston body can be reduced as well as the weight of the product. This leads to a reduction in the total length of the fluid pressure cylinder. Alternatively, the distance between the magnetic sensor and the magnet can be adjusted. Alternatively, the piston rod can be rotated without affecting the distance between the magnetic sensor and the magnet.

The above-described object, features, and advantages will become more apparent from the following description of preferred embodiments in conjunction with the accompanying drawings.

DESCRIPTION OF EMBODIMENTS

Preferred embodiments of a fluid pressure cylinder according to the present invention will be described in detail below with reference to the accompanying drawings.

Figure 1:
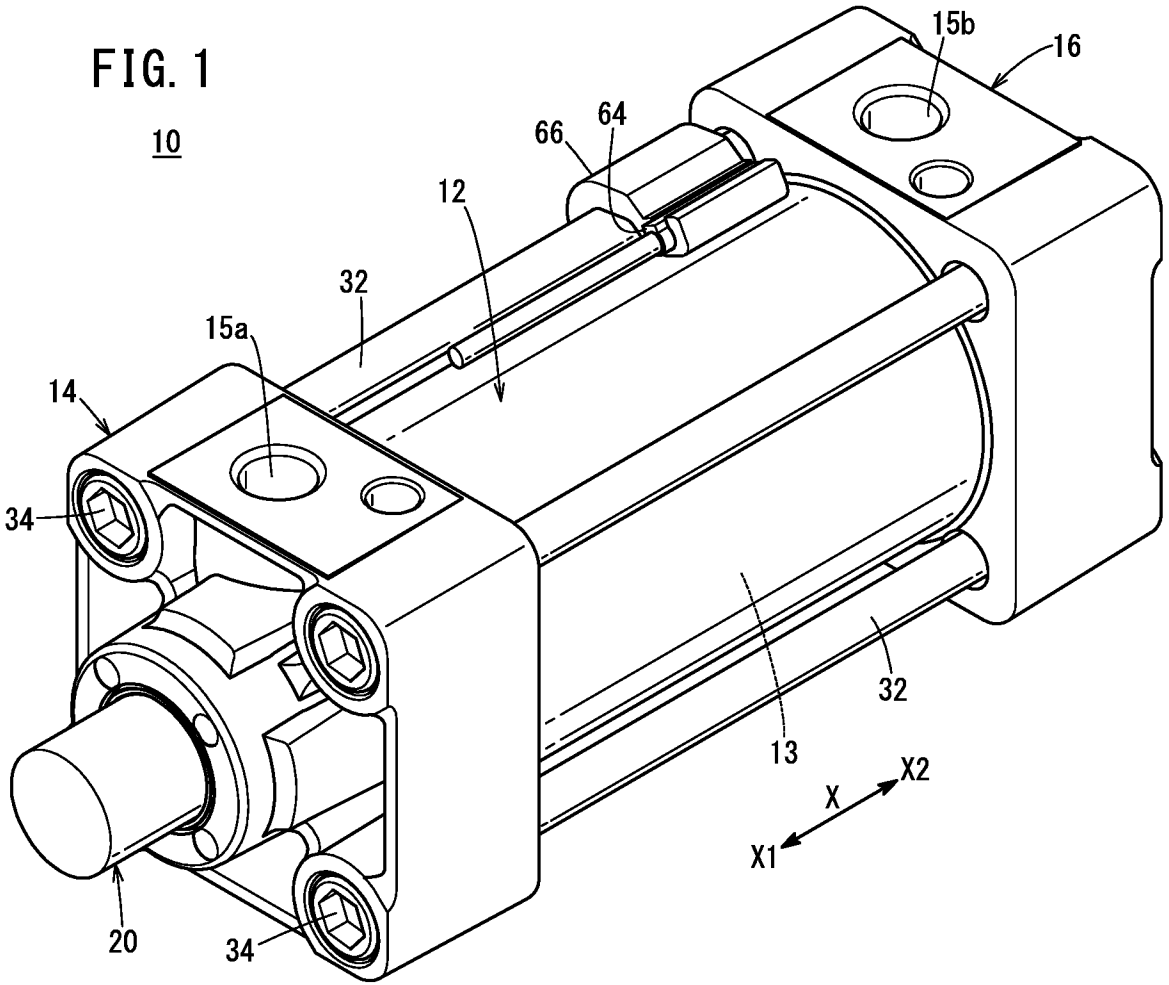
FIG. 1 is a perspective view of a fluid pressure cylinder according to a first embodiment of the present invention.
Figure 2:
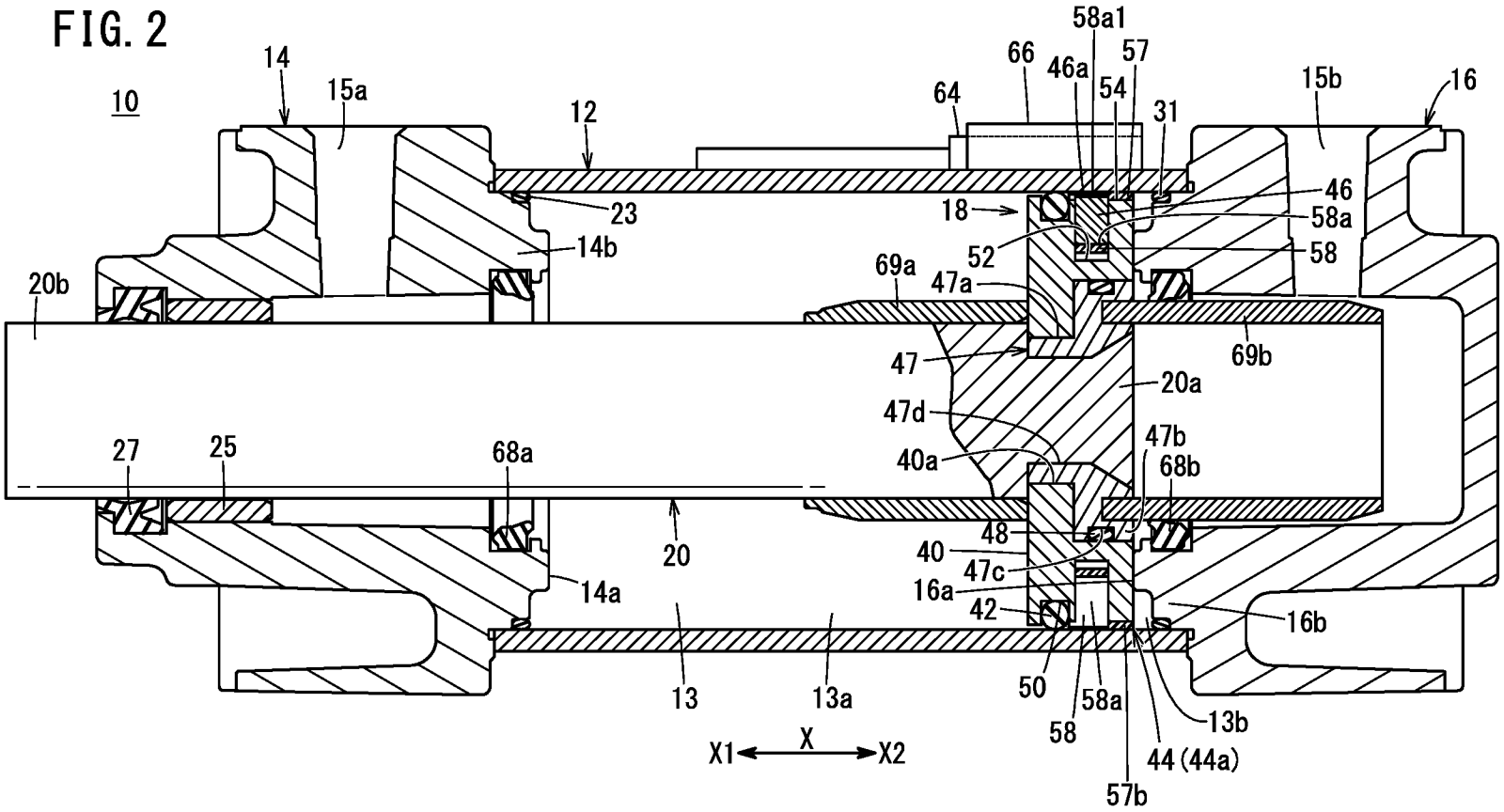
FIG. 2 is a cross-sectional view of the fluid pressure cylinder illustrated in FIG. 1.
Figure 3:
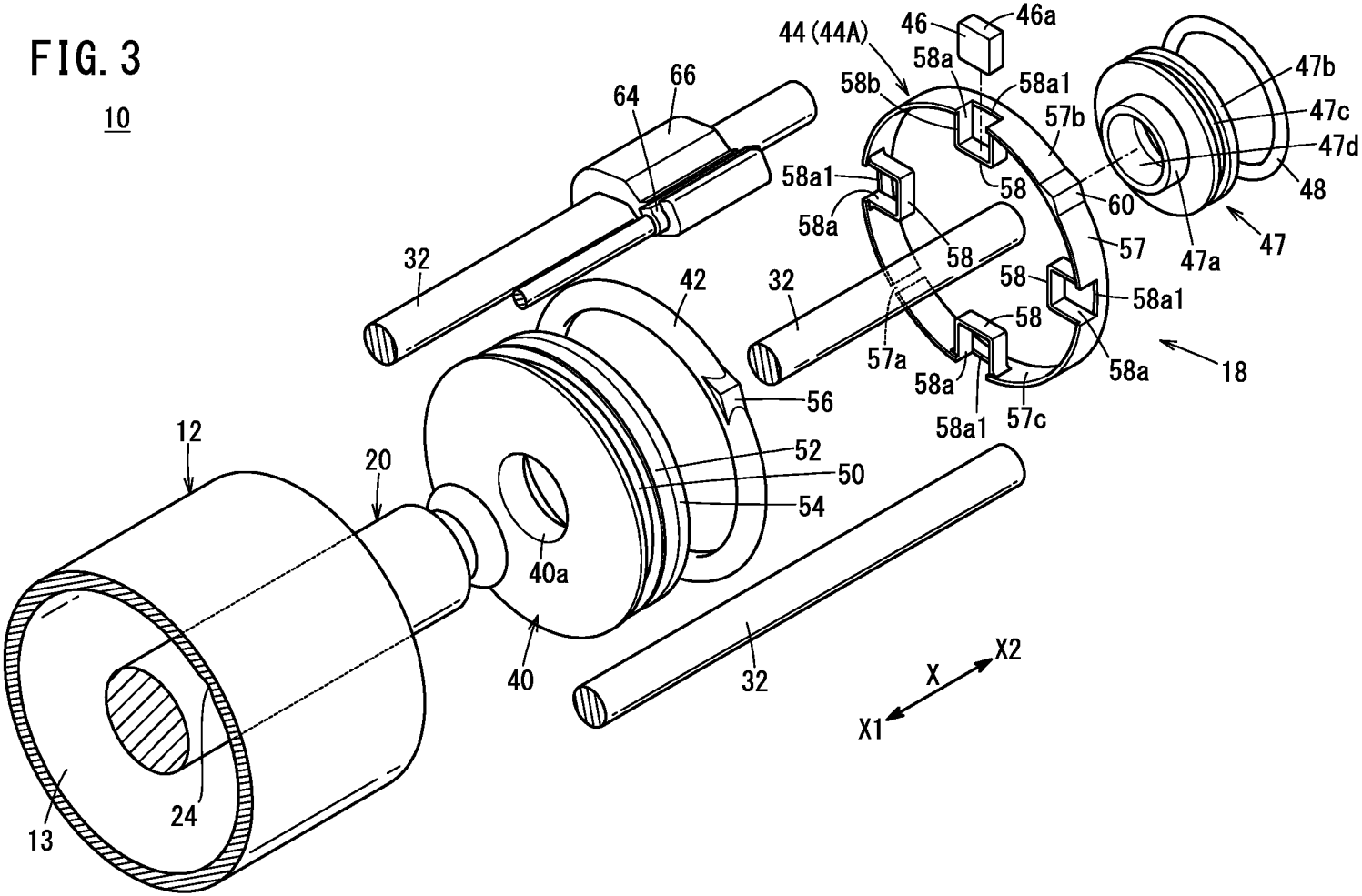
FIG. 3 is an exploded perspective view of the fluid pressure cylinder illustrated in FIG. 1.

A fluid pressure cylinder 10 according to a first embodiment illustrated in FIG. 1 includes a hollow tubular cylinder tube 12 having a circular slide hole 13 (cylinder chamber) inside the cylinder tube 12, a rod cover 14 disposed at one end part of the cylinder tube 12, and a head cover 16 disposed at another end part of the cylinder tube 12. As illustrated in FIGS. 2 and 3, the fluid pressure cylinder 10 further includes a piston unit 18 disposed inside the cylinder tube 12 to be movable in the axial direction (X direction) and a piston rod 20 connected to the piston unit 18. The fluid pressure cylinder 10 is used as an actuator for, for example, carrying a workpiece.

The cylinder tube 12 is a tubular body composed of, for example, a metal material such as aluminum alloy and extends in the axial direction. In the first embodiment, the cylinder tube 12 has a hollow cylindrical shape.

A detent groove 24 extending in the axial direction of the cylinder tube 12 is provided in the inner circumferential surface of the cylinder tube 12. The detent groove 24 is tapered (into a trapezoidal shape or a triangular shape) such that the width (circumferential width) thereof decreases radially outward. The detent groove 24 may have other polygonal shapes (for example, rectangular shape). In the first embodiment, the detent groove 24 is formed in the inner circumferential surface of the cylinder tube 12 at one point in the circumferential direction. Note that a plurality of (for example, three) detent grooves 24 may be formed in the inner circumferential surface of the cylinder tube 12 at intervals in the circumferential direction.

As illustrated in FIGS. 1 and 2, the rod cover 14 is provided to block up the one end part (an end part facing a direction of an arrow X1) of the cylinder tube 12, and is composed of, for example, a metal material similar to the material of the cylinder tube 12. The rod cover 14 has a first port 15*a*. As illustrated in FIG. 2, an annular protruding portion 14*b* provided for the rod cover 14 is fitted in the one end part of the cylinder tube 12.

A packing 23 with a circular ring shape is disposed between the rod cover 14 and the cylinder tube 12. A bush 25 with a circular ring shape and a packing 27 with a circular ring shape are disposed in an inner circumferential part of the rod cover 14. A first cushion packing 68*a* with a circular ring shape is disposed in the inner circumferential part of the rod cover 14.

The head cover 16 is composed of, for example, a metal material similar to the material of the cylinder tube 12 and is provided to block up the other end part (an end part facing a direction of an arrow X2) of the cylinder tube 12. The head cover 16 hermetically closes the other end part of the cylinder tube 12. The head cover 16 has a second port 15*b*.

An annular protruding portion 16*b* provided for the head cover 16 is fitted in the other end part of the cylinder tube 12. A packing 31 with a circular ring shape is disposed between the head cover 16 and the cylinder tube 12. A second cushion packing 68*b* with a circular ring shape is disposed in an inner circumferential part of the head cover 16.

As illustrated in FIG. 1, the cylinder tube 12, the rod cover 14, and the head cover 16 are fastened to each other in the axial direction by a plurality of connecting rods 32 and nuts 34. The plurality of pairs of connecting rods 32 and nuts 34 are disposed at intervals in the circumferential direction. Thus, the cylinder tube 12 is secured while being held between the head cover 16 and the rod cover 14.

As illustrated in FIG. 2, the piston unit 18 is accommodated inside the cylinder tube 12 (slide hole 13) to be slidable in the axial direction and partitions the slide hole 13 into a first pressure chamber 13*a* on the first port 15*a* side and a second pressure chamber 13*b* on the second port 15*b* side. In this embodiment, the piston unit 18 is connected to a base end portion 20*a* of the piston rod 20.

The piston unit 18 includes a circular piston body 40 protruding radially outward from the piston rod 20, a packing 42 with a circular ring shape attached to an outer circumferential part of the piston body 40, a holding member 44 attached to the outer circumferential part of the piston body 40, a magnet 46 disposed partially in the circumferential direction of the piston body 40, and a ring-shaped spacer 47 disposed between the piston rod 20 and the piston body 40.

The piston body 40 has a through-hole 40*a* passing therethrough in the axial direction. The spacer 47 is fitted in the through-hole 40*a* of the piston body 40. The spacer 47 has a through-hole 47*d* passing through in the axial direction. The spacer 47 includes a small diameter portion 47*a* and a large diameter portion 47*b*. A ring-shaped seal member 48 composed of an elastic material is disposed in a ring-shaped groove 47*c* formed in an outer circumferential part of the large diameter portion 47*b*. The seal member 48 airtightly or fluid tightly adheres to the piston body 40 and the spacer 47. The piston body 40 is rotatable relative to the spacer 47.

The base end portion 20*a* (small diameter portion) of the piston rod 20 is fitted in the through-hole 47*d* of the spacer 47 and secured (connected) to the spacer 47 by swaging. The piston rod 20 and the spacer 47 may be secured to each other by screwing instead of swaging.

A packing receiving groove 50, a magnet arrangement groove 52, and a wear ring supporting surface 54 are formed in the outer circumferential part of the piston body 40 at different axial positions. The magnet arrangement groove 52 is disposed between the packing receiving groove 50 and the wear ring supporting surface 54. The packing receiving groove 50 and the magnet arrangement groove 52 each have a circular ring shape extending around the entire circumference in the circumferential direction.

The constituent material of the piston body 40 includes, for example, metal materials such as carbon steel, stainless steel, and aluminum alloy and hard resin.

The packing 42 is a ring-shaped seal member (for example, O-ring) composed of an elastic material such as rubber or elastomer. The packing 42 is fitted in the packing receiving groove 50.

The packing 42 is in contact with the inner circumferential surface of the cylinder tube 12 to be slidable. Specifically, an outer circumferential part of the packing 42 airtightly or fluid tightly adheres to the inner circumferential surface of the slide hole 13 around the entire circumference. An inner circumferential part of the packing 42 airtightly or fluid tightly adheres to the outer circumferential surface of the piston body 40 around the entire circumference. The packing 42 seals a gap between the outer circumferential surface of the piston unit 18 and the inner circumferential surface of the slide hole 13 to airtightly or fluid tightly separate the first pressure chamber 13*a* and the second pressure chamber 13*b* from each other inside the slide hole 13.

As illustrated in FIG. 3, a projection 56 that is inserted into the detent groove 24 and is in contact with the inner surface of the detent groove 24 to be slidable is disposed on the outer circumferential part of the packing 42. The projection 56 has a polygonal shape similar to the shape of the detent groove 24. That is, the projection 56 is tapered (into a trapezoidal shape or a triangular shape) such that the width (circumferential width) thereof decreases radially outward. The projection 56 airtightly or fluid tightly adheres to the detent groove 24.

The engagement of the projection 56 with the detent groove 24 restricts rotation of the packing 42 relative to the cylinder tube 12. Since the piston rod 20 is rotatable with respect to the piston body 40, the piston body 40 to which the packing 42 is attached does not rotate even when the piston rod 20 rotates.

In a case where a plurality of detent grooves 24 are formed in the inner circumferential surface of the cylinder tube 12 at intervals in the circumferential direction, a plurality (same number as the detent grooves 24) of projections 56 may be disposed on the packing 42 at intervals in the circumferential direction.

The holding member 44 is attached to the piston body 40 that is supported by the spacer 47 to be relatively rotatable. Thus, the holding member 44 is rotatable relative to the piston rod 20. The holding member 44 includes a circumferential portion 57 extending in the circumferential direction along the outer circumferential part of the piston body 40 and magnet holding portions 58 protruding from the circumferential portion 57. The plurality (four in the figure) of magnet holding portions 58 are disposed at intervals in the circumferential direction. The number of magnet holding portions 58 may be one.

The magnet holding portions 58 are fitted in the magnet arrangement groove 52 of the piston body 40. The magnet holding portions 58 each have a magnet holding grooves 58*a* with a cavity 58*a*1 opening in the outer circumferential surface of the holding member 44. The magnet 46 is held (fitted) in the corresponding magnet holding groove 58*a*.

The magnet holding portions 58 protrude from an inner circumferential surface 57*c* of the circumferential portion 57 radially inward. More specifically, the magnet holding portions 58 each have a U-shaped frame portion 58*b* protruding from the circumferential portion 57 radially inward, and the frame portions 58*b* form the magnet holding portions 58. Thus, one end and another end of each magnet holding portion 58 in the axial direction are open. The cavities 58*a*1 are opened in an outer circumferential surface 57*b* of the circumferential portion 57. That is, the cavities 58*a*1 are hole portions passing through the circumferential portion 57 in the thickness directions (radial directions).

In the first embodiment, the axial dimension of the magnet holding portions 58 is smaller than the axial dimension of the circumferential portion 57. The magnet holding portions 58 are formed within the axial dimension of the circumferential portion 57.

In the first embodiment, the holding member 44 is a wear ring 44A configured to prevent the piston body 40 from coming into contact with the cylinder tube 12, and is attached to the wear ring supporting surface 54. The wear ring 44A prevents the outer circumferential surface of the piston body 40 from coming into contact with the inner circumferential surface of the slide hole 13 when a large lateral load is applied to the piston unit 18 in a direction perpendicular to the axial direction while the fluid pressure cylinder 10 is in operation. The outer diameter of the wear ring 44A is larger than the outer diameter of the piston body 40.

The wear ring 44A is composed of a low friction material. The friction coefficient between the wear ring 44A and the inner circumferential surface of the slide hole 13 is smaller than the friction coefficient between the packing 42 and the inner circumferential surface of the slide hole 13. Such a low friction material includes, for example, synthetic resins with a low coefficient of friction but a high resistance to wear such as polytetrafluoroethylene (PTFE) and metal materials (for example, bearing steel).

The circumferential portion 57 is fitted on the wear ring supporting surface 54 of the piston body 40. The circumferential portion 57 has a circular ring shape with a slit 57*a* (gap) left at a point in the circumferential direction. The slit 57*a* is left at a position offset from the magnet holding portions 58 in the circumferential direction. Specifically, the slit 57*a* is left between the magnet holding portions 58 adjacent to each other in the circumferential direction. During assembly, the holding member 44 is forcibly expanded in radial directions and is disposed around the wear ring supporting surface 54, and is then attached to the magnet arrangement groove 52 and the wear ring supporting surface 54 as the diameter of the holding member 44 shrinks by the elastic restoring force.

Rotation of the holding member 44 relative to the cylinder tube 12 is restricted. Specifically, in the first embodiment, the detent groove 24 is formed in the inner circumferential surface of the cylinder tube 12 in the axial direction of the cylinder tube 12, and a detent protrusion 60 engaging with the detent groove 24 is provided for the holding member 44. The detent protrusion 60 is slidable in the detent groove 24 in the axial direction.

The detent protrusion 60 protrudes radially outward from an outer circumferential part of the holding member 44. The detent protrusion 60 is provided for the outer circumferential surface 57*b* of the circumferential portion 57 at a position offset from the magnet holding portions 58 in the circumferential direction. The detent protrusion 60 stretches the full axial dimension of the circumferential portion 57. The detent protrusion 60 may be provided at a position overlapping with one of the magnet holding portions 58 in the circumferential direction.

Figure 4A:
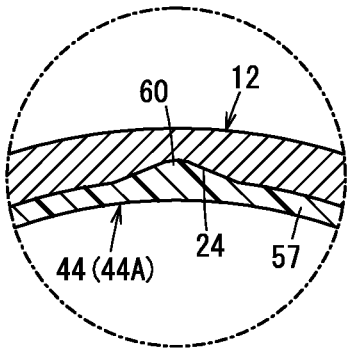
FIG. 4A is a cross-sectional view illustrating a structure (with a polygonal shape) restricting rotation of a holding member relative to a cylinder tube.

As illustrated in FIG. 4A, the detent protrusion 60 has a polygonal shape similar to the shape of the detent groove 24. That is, the detent protrusion 60 is tapered (into a trapezoidal shape or a triangular shape) such that the width (circumferential width) thereof decreases radially outward. In a case where a plurality of detent grooves 24 are formed in the inner circumferential surface of the cylinder tube 12 at intervals in the circumferential direction, a plurality (same number as the detent grooves 24 or less) of detent protrusions 60 may be disposed on the holding member 44 at intervals in the circumferential direction.

Figure 4B:
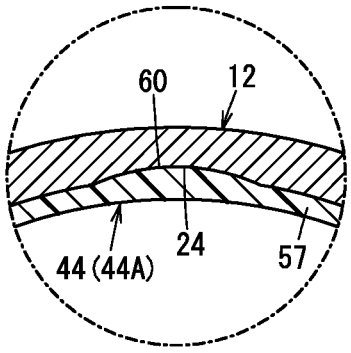
FIG. 4B is a cross-sectional view illustrating a structure (with an arc shape) restricting rotation of the holding member relative to the cylinder tube.

The detent groove 24 is not necessarily tapered, and may be arc-shaped in section as illustrated in FIG. 4B. In this case, the detent protrusion 60 provided for the holding member 44 has an arc shape similar to the shape of the detent groove 24. In the case where the detent groove 24 has an arc shape, the projection 56 (see FIG. 3) may not be provided for the packing 42. The sealing performance can also be maintained in this case since the outer circumferential part of the packing 42 elastically deforms along the arc shape of the detent groove 24.

As illustrated in FIG. 3, the magnet 46 has a non-ring shape (point shape) existing in the piston body 40 only at a point in the circumferential direction, and is fitted in the corresponding magnet holding portion 58 (magnet holding groove 58*a*). In the first embodiment, the magnet 46 is fitted in only one of the plurality of magnet holding portions 58. As illustrated in FIG. 2, an outer end 46*a* of the magnet 46 is disposed at the corresponding cavity 58*a*1 of the holding member 44. In other words, the outer end 46*a* of the magnet 46 is disposed within the thickness of the circumferential portion 57. The outer end 46*a* of the magnet 46 directly faces the inner circumferential surface of the cylinder tube 12. The magnet 46 is, for example, a ferrite magnet, a rare earth magnet, or the like.

As illustrated in FIG. 2, a magnetic sensor 64 is attached to the outside of the cylinder tube 12. Specifically, a sensor bracket 66 is attached to the corresponding connecting rod 32 (see FIG. 1). The magnetic sensor 64 is held by the sensor bracket 66. Thus, the magnetic sensor 64 is secured in place with respect to the head cover 16 and the rod cover 14 via the sensor bracket 66 and the connecting rod 32. The magnetic sensor 64 detects magnetism generated by the magnet 46 to detect the working position of the piston unit 18.

The piston rod 20 is a columnar (circular cylindrical) member extending in the axial direction of the slide hole 13. The piston rod 20 passes through the rod cover 14. A leading end portion 20*b* of the piston rod 20 is exposed to the outside of the slide hole 13. A first cushion ring 69*a* is secured to an outer circumferential part of the piston rod 20 at a position on a side of the piston body 40 adjacent to the rod cover 14. A second cushion ring 69*b* is secured to the spacer 47 on a side of the piston body 40 opposite the side on which the first cushion ring 69*a* lies to be coaxial with the piston rod 20.

The first cushion packing 68*a*, the second cushion packing 68*b*, the first cushion ring 69*a*, and the second cushion ring 69*b* constitute an air cushion mechanism reducing impact at stroke ends. Instead of or in addition to such an air cushion mechanism, dampers composed of an elastic material such as rubber may be attached to, for example, an inner wall surface 14*a* of the rod cover 14 and an inner wall surface 16*a* of the head cover 16.

The fluid pressure cylinder 10 configured as above operates as follows. In the description below, air (compressed air) is used as pressurized fluid. However, gas other than air may be used.

In FIG. 2, in the fluid pressure cylinder 10, the piston unit 18 is moved inside the slide hole 13 in the axial direction by the effect of the air serving as the pressurized fluid introduced via the first port 15*a* or the second port 15*b*. This causes the piston rod 20 connected to the piston unit 18 to move back and forth.

Specifically, to displace (advance) the piston unit 18 toward the rod cover 14, pressurized fluid is supplied from a pressurized fluid supply source (not illustrated) to the second pressure chamber 13*b* via the second port 15*b* while the first port 15*a* is exposed to the atmosphere. This causes the piston unit 18 to be pushed by the pressurized fluid toward the rod cover 14. Thus, the piston unit 18 is displaced (advanced) toward the rod cover 14 together with the piston rod 20.

When the piston unit 18 comes into contact with the rod cover 14, the advancing motion of the piston unit 18 stops. As the piston unit 18 approaches the advanced position, the first cushion ring 69*a* comes into contact with the inner circumferential surface of the first cushion packing 68*a*. This creates an airtight seal at the contact part and thus creates an air cushion in the first pressure chamber 13*a*. As a result, the displacement of the piston unit 18 in the vicinity of the stroke end on the rod cover 14 side is decelerated, and the impact occurring when the piston unit 18 reaches the stroke end is reduced.

On the other hand, to displace (return) the piston body 40 toward the head cover 16, pressurized fluid is supplied from the pressurized fluid supply source (not illustrated) to the first pressure chamber 13*a* via the first port 15*a* while the second port 15*b* is exposed to the atmosphere. This causes the piston body 40 to be pushed by the pressurized fluid toward the head cover 16. Thus, the piston unit 18 is displaced toward the head cover 16.

When the piston unit 18 comes into contact with the head cover 16, the returning motion of the piston unit 18 stops. As the piston unit 18 approaches the returned position, the second cushion ring 69*b* comes into contact with the inner circumferential surface of the second cushion packing 68*b*. This creates an airtight seal at the contact part and thus creates an air cushion in the second pressure chamber 13*b*. As a result, the displacement of the piston unit 18 in the vicinity of the stroke end on the head cover 16 side is decelerated, and the impact occurring when the piston unit 18 reaches the stroke end is reduced.

In this case, the fluid pressure cylinder 10 according to the first embodiment produces the following effects.

According to the fluid pressure cylinder 10, the magnet 46 is disposed only at the required point in the circumferential direction. Thus, the weight of the product can be reduced.

Furthermore, since the magnet holding portions 58 have the cavities 58*a*1 opened in the outer circumferential surface of the holding member 44, the magnet 46 can be disposed at a position adjacent to the inner circumferential surface of the cylinder tube 12. As the distance between the magnetic sensor 64 attached to the outside of the cylinder tube 12 and the magnet 46 disposed inside the cylinder tube 12 can be reduced, the magnetic force required for the magnet 46 can be reduced. This allows the axial thickness of the magnet 46 to be reduced. Consequently, the axial dimension of the piston body 40 can be reduced, leading to a reduction in the total length of the fluid pressure cylinder 10.

The outer end 46*a* of the magnet 46 is disposed at the corresponding cavity 58*a*1. According to the structure, the magnet 46 can be disposed even closer to the inner circumferential surface of the cylinder tube 12, resulting in an effective reduction in the axial thickness of the magnet 46.

As illustrated in FIG. 3, the holding member 44 includes the circumferential portion 57 extending in the circumferential direction along the outer circumferential part of the piston body 40. The magnet holding portions 58 protrude from the inner circumferential surface 57*c* of the circumferential portion 57 radially inward. In addition, the cavities 58*a*1 are opened in the outer circumferential surface 57*b* of the circumferential portion 57. According to the structure, the axial dimension of the holding member 44 can be reduced, resulting in a further reduction in the axial dimension of the piston body 40.

The magnet holding portions 58 are formed within the axial dimension of the circumferential portion 57. According to the structure, the axial dimension of the holding member 44 can be reduced more effectively.

The holding member 44 is provided with, at a position offset from the magnet holding portions 58 in the circumferential direction, the detent protrusion 60 preventing the holding member 44 from rotating with respect to the cylinder tube 12. According to the structure, the length of the detent protrusion 60 can be easily ensured to allow the detent protrusion 60 to function as a detent in a preferred manner.

The slide hole 13 and the piston body 40 are circular. The holding member 44 is rotatable relative to the piston rod 20. The piston rod 20 is rotatable relative to the cylinder tube 12. Rotation of the holding member 44 relative to the cylinder tube 12 is restricted. According to the structure, when the cylinder tube 12 is rotated with respect to the rod cover 14 and the head cover 16, the magnet 46 held by the holding member 44 disposed inside the cylinder tube 12 also rotates in an integrated manner. Thus, the magnetic force exerted on the magnetic sensor 64 can be easily adjusted by adjusting the distance between the magnetic sensor 64 disposed outside the cylinder tube 12 and the magnet 46 (positional relationship between the magnetic sensor 64 and the magnet 46 in the circumferential direction). Consequently, various types of magnetic sensors 64 with different sensitivities can be used without changing the cylinder structure.

The detent groove 24 extending in the axial direction of the cylinder tube 12 is provided in the inner circumferential surface of the cylinder tube 12. The holding member 44 is provided with the detent protrusion 60 fitted in the detent groove 24. This simple structure enables the rotation of the holding member 44 and the cylinder tube 12 relative to each other to be restricted.

In the case where the detent groove 24 and the detent protrusion 60 have a polygonal shape as illustrated in FIG. 4A, rotation of the holding member 44 and the cylinder tube 12 relative to each other can be restricted in a preferred manner.

In the case where the detent groove 24 and the detent protrusion 60 have an arc shape as illustrated in FIG. 4B, the packing 42 readily provides a desired sealing performance. Moreover, in this case, the packing 42 does not require the projection 56, and a similar typical packing can be used. This allows simplification of the structure and provides increased economy.

The projection 56 that is inserted into the detent groove 24 and is in contact with the inner surface of the detent groove 24 to be slidable is disposed on the outer circumferential part of the packing 42. According to the structure, sealing performance at the area of the detent groove 24 (airtightness or fluid tightness between the first pressure chamber 13*a* and the second pressure chamber 13*b*) can be enhanced in a preferred manner.

The piston body 40 is rotatable relative to the piston rod 20. According to the structure, the projection 56 of the packing 42 is prevented from being detached from the detent groove 24, so that the sealing performance of the packing 42 can be maintained in a preferred manner.

The holding member 44 is the wear ring 44A configured to prevent the piston body 40 from coming into contact with the cylinder tube 12. Thus, the holding member 44 serves both as the wear ring 44A and a member holding the magnet 46, leading to simplification of the structure.

Figure 5:
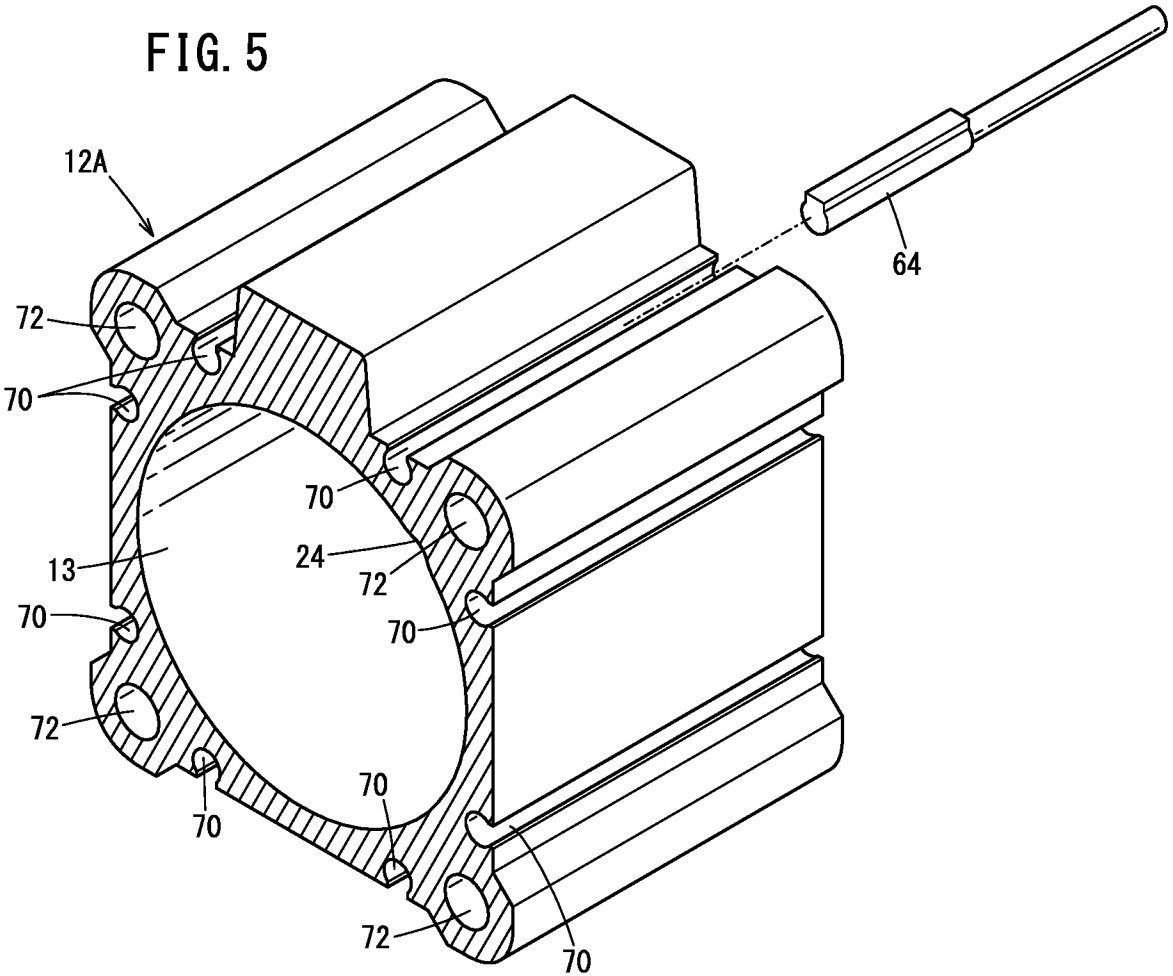
FIG. 5 is a perspective view of a cylinder tube according to another structure.

In the above-described fluid pressure cylinder 10, a cylinder tube 12A illustrated in FIG. 5 may be used instead of the cylinder tube 12. The cylinder tube 12A has an approximately quadrangular outer shape. A plurality of sensor receiving grooves 70 extending in the axial direction are formed in an outer circumferential part of the cylinder tube 12A. Specifically, two sensor receiving grooves 70 are formed in each of four faces forming the outer circumferential part of the cylinder tube 12A (eight sensor receiving grooves 70 in total). Thus, the magnetic sensor 64 is attached at a fixed position outside the cylinder tube 12A. The detent groove 24 is provided in the inner circumferential surface of the cylinder tube 12A.

Rod insertion holes 72 are created in the corners of the quadrangular cylinder tube 12A. Bolts for attaching the cylinder are fitted in the rod insertion holes 72. Thus, in the case where the cylinder tube 12A is used in the fluid pressure cylinder 10, the circumferential position of the cylinder tube 12A cannot be adjusted (the cylinder tube 12A does not rotate even when the bolts for attaching the cylinder are loosened).

In the fluid pressure cylinder 10 using the cylinder tube 12A, the distance between the magnetic sensor 64 and the magnet 46 is unchanged even when the piston rod 20 is rotated. This conveniently allows the piston rod 20 to be rotated without changing the distance between the magnetic sensor 64 and the magnet 46 when, for example, the fluid pressure cylinder 10 is installed in equipment.

Figure 6:
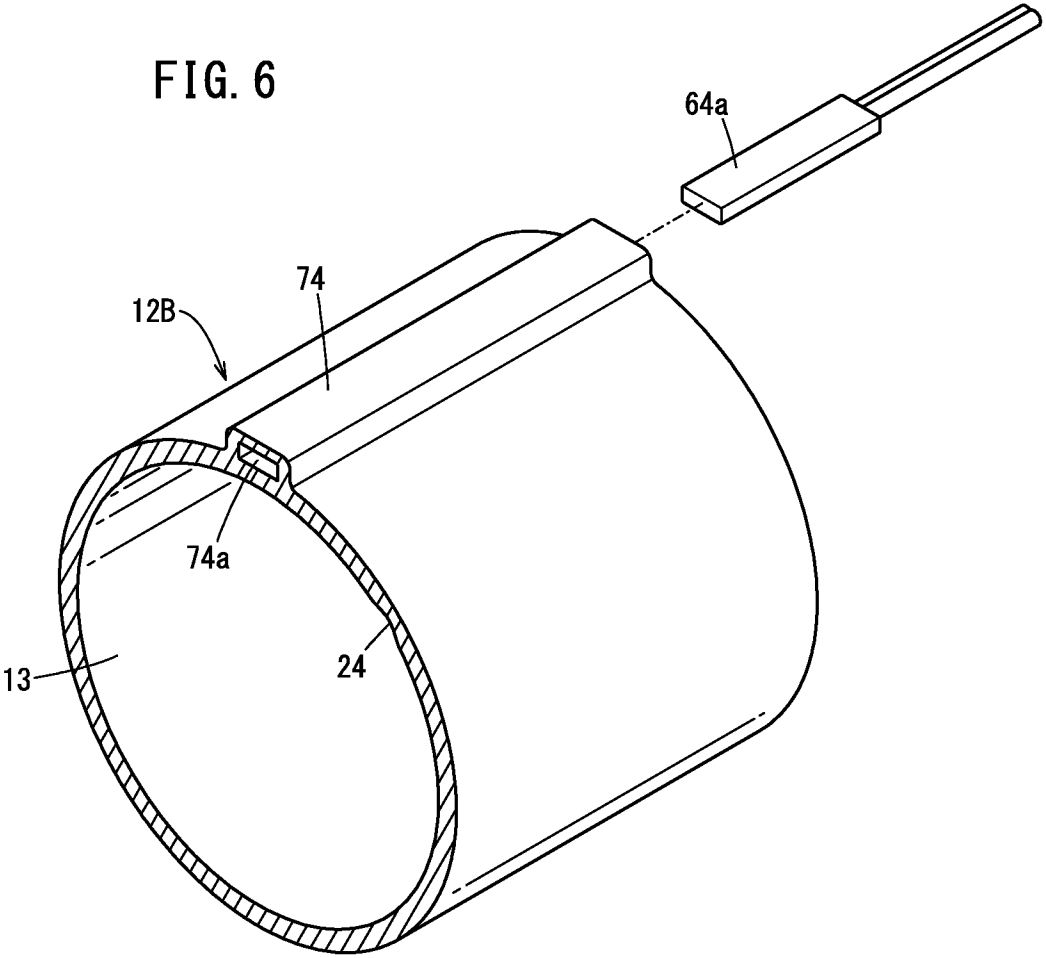
FIG. 6 is a perspective view of a cylinder tube according to yet another structure.

In the above-described fluid pressure cylinder 10, a cylinder tube 12B illustrated in FIG. 6 may be used instead of the cylinder tube 12. The cylinder tube 12B is provided with a protrusion 74 extending in the axial direction at a portion of an outer circumferential part of the cylinder tube 12B. A magnetic sensor receiving slot 74*a* is created inside the protrusion 74. A flat, thin (low-profile) magnetic sensor 64*a* is inserted into the magnetic sensor receiving slot 74*a*. The detent groove 24 is provided in the inner circumferential surface of the cylinder tube 12B.

In the fluid pressure cylinder 10 using the cylinder tube 12B, the distance between the magnetic sensor 64*a* and the magnet 46 is unchanged even when the piston rod 20 is rotated. This conveniently allows the piston rod 20 to be rotated without changing the distance between the magnetic sensor 64*a* and the magnet 46 when, for example, the fluid pressure cylinder 10 is installed in equipment. Moreover, since the magnetic sensor 64*a* is inserted into the magnetic sensor receiving slot 74*a* created adjacent to the inner circumferential surface of the cylinder tube 12B, the distance between the magnetic sensor 64*a* and the magnet 46 (see FIG. 2) can be further reduced. Consequently, the axial thickness of the magnet 46 can be reduced more effectively.

Figure 7:
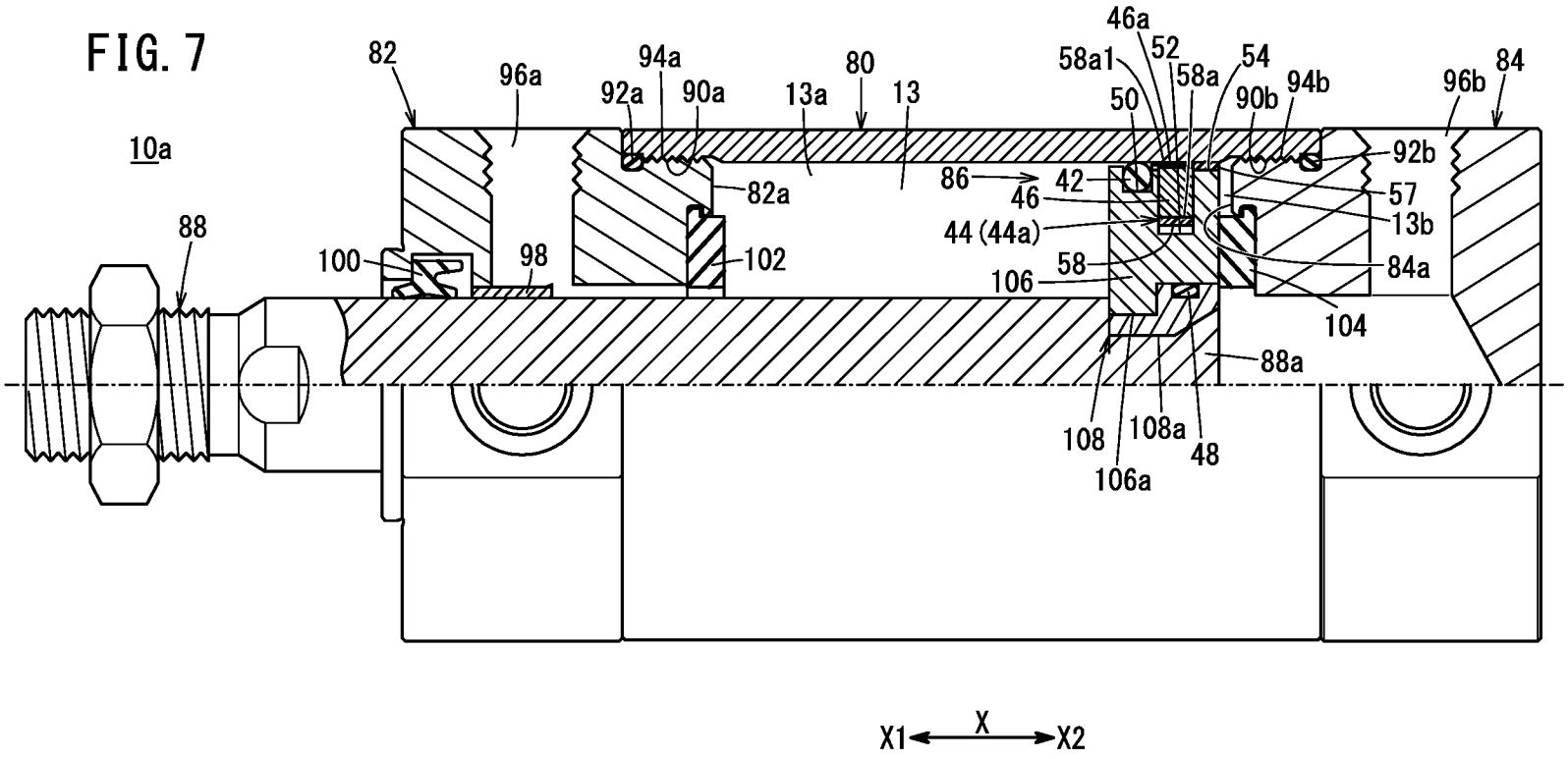
FIG. 7 is a partially sectioned side view of a fluid pressure cylinder according to a second embodiment of the present invention.

A fluid pressure cylinder 10*a* according to a second embodiment illustrated in FIG. 7 includes a hollow tubular cylinder tube 80 having the circular slide hole 13 inside the cylinder tube 80, a rod cover 82 disposed at one end part of the cylinder tube 80, a head cover 84 disposed at another end part of the cylinder tube 80, a piston unit 86 disposed inside the cylinder tube 80 to be movable in the axial direction (X direction), and a piston rod 88 connected to the piston unit 86.

The cylinder tube 80 has a hollow cylindrical shape. Internal thread portions 90*a* and 90*b* are formed on the inner circumferential surface of both end parts of the cylinder tube 80. The detent groove 24 (see FIG. 3) extending in the axial direction of the cylinder tube 80 is provided in the inner circumferential surface of the cylinder tube 80. Packings 92*a* and 92*b* with a circular ring shape are respectively disposed between the cylinder tube 80 and the rod cover 82 and between the cylinder tube 80 and the head cover 84.

Although not illustrated in detail, the magnetic sensor 64 (see FIG. 1, for example) is attached to the outer circumferential surface of the cylinder tube 80 at a freely selected position using a sensor mounting band. The sensor mounting band includes a sensor holder holding the magnetic sensor 64 and a band portion securing the sensor holder to an outer circumferential part of the cylinder tube 80. Since the magnetic sensor 64 can be disposed at a freely selected position on the outer circumferential part of the cylinder tube 80, the magnetic sensor 64 can be attached after the distance between the magnetic sensor 64 and the magnet 46 (positional relationship in the circumferential direction) is adjusted.

An external thread portion 94*a* formed on the rod cover 82 engages with the internal thread portion 90*a* formed on the inner circumferential surface of the one end part of the cylinder tube 80. The rod cover 82 has a first port 96*a*. A bush 98 with a circular ring shape and a packing 100 with a circular ring shape are disposed in an inner circumferential part of the rod cover 82.

A damper 102 composed of an elastic material is attached to an inner wall surface 82*a* of the rod cover 82. An external thread portion 94*b* formed on the head cover 84 engages with the internal thread portion 90*b* formed on the inner circumferential surface of the other end part of the cylinder tube 80. The head cover 84 has a second port 96*b*. A damper 104 composed of an elastic material is attached to the inner wall surface 84*a* of the head cover 84.

The piston unit 86 includes a circular piston body 106 protruding radially outward from the piston rod 88, the packing 42 attached to an outer circumferential part of the piston body 106, the holding member 44 attached to the outer circumferential part of the piston body 106, and the magnet 46 disposed partially in the circumferential direction of the piston body 106. A spacer 108 is disposed between the piston body 106 and a base end portion 88*a* (small diameter portion) of the piston rod 88.

The spacer 108 is fitted in a through-hole 106*a* created in the piston body 106, and the base end portion 88*a* of the piston rod 88 is fitted in a through-hole 108*a* created in the spacer 108. The spacer 108 and the piston rod 88 are secured by swaging. The spacer 108 and the piston rod 88 may be secured to each other by screwing instead of swaging. The fluid pressure cylinder 10*a* according to the second embodiment also produces effects similar to the effects of the fluid pressure cylinder 10 according to the first embodiment. That is, since each magnet holding groove 58*a* provided for the corresponding magnet holding portion 58 has the cavity 58*a*1 opened in the outer circumferential surface of the holding member 44, the axial thickness of the magnet 46 can be reduced. Thus, the axial dimension of the piston body 106 can be reduced. Moreover, the distance between the magnetic sensor 64 and magnet 46 is unchanged even when the piston rod 88 is rotated after the magnetic sensor 64 is attached to the outer circumferential part of the cylinder tube 80 (after the circumferential distance between the magnetic sensor 64 and the magnet 46 is set). This conveniently allows the piston rod 88 to be rotated without changing the distance between the magnetic sensor 64 and the magnet 46 when, for example, the fluid pressure cylinder 10*a* is installed in equipment.

Other components of the second embodiment common to those of the first embodiment produce effects identical or similar to those of the first embodiment.

The present invention is not limited in particular to the embodiments described above, and various modifications can be made thereto without departing from the scope of the present invention.

The invention claimed is:

1. A fluid pressure cylinder comprising:

a cylinder tribe including a slide hole imide the cylinder tube;

a piston unit disposed to be reciprocable along the slide hole; and a piston rod protruding from the piston unit in an axial direction, wherein the piston unit includes:

a piston body protruding radially outward from the piston rod;

a packing attached to an outer circumferential part of the piston body;

a holding member attached to the outer circumferential part of the piston body and including a magnet holding portion; and a magnet held by the magnet holding portion and disposed partially in a circumferential direction of the piston body, and wherein the magnet bolding portion has a cavity opened in an outer circumferential surface of the holding member, wherein:

the holding member includes a circumferential portion extending in the circumferential direction along the outer circumferential part of the piston body;

the magnet holding portion protrudes inward from an inner circumferential surface of the circumferential portion; and the cavity is opened in an outer circumferential surface of circumferential portion.

2. The fluid pressure cylinder according to claim 1, wherein the magnet holding portion is formed within an axial dimension of the circumferential.

3. The fluid pressure cylinder according to claim 2, wherein the holding member is provided with, at a position offset from the magnet holding portion in the circumferential direction, a detest protrusion configured to prevent the holding member from rotating with respect to the cylinder tube.

4. The fluid pressure cylinder according to claim 1, wherein the holding member is a wear ring configured to prevent the piston body from coming into contact with the cylinder tube.

5. A fluid pressure cylinder comprising:

a cylinder tube including a slide hole inside the cylinder tube;

a piston unit disposed to be reciprocable along the slide hole; and a piston rod protruding from the piston unit in an axial direction, wherein the piston unit includes:

a piston body protruding radially outward from the piston rod;

a packing attached to an outer circumferential part of the piston body;

a holding member attached to the outer circumferential part of the piston body and including a magnet holding portion; and a magnet held by the magnet holding portion and disposed partially in a circumferential direction of the piston body, and wherein the magnet holding portion has a cavity opened in an outer circumferential surface of the holding member, wherein:

the slide hole arm the piston body are circular;

the holding member is rotatable relative to the piston rod;

the piston rod is rotatable relative to the cylinder tube; and rotation of the holding member relative to the cylinder tube is restricted.

6. The fluid pressure cylinder according to claim 5, wherein:

a detent groove extending in an axial direction of the cylinder tube is provided in an inner circumferential surface of the cylinder tube; and the holding member is provided with a detent protrusion fitted in the detent groove.

7. The fluid pressure cylinder according to claim 6, wherein a projection that is inserted into the detent groove and is in contact with an inner surface of the detent groove to be slidable is disposed on an outer circumferential part of the packing.

8. The fluid pressure cylinder according to claim 7, wherein the piston body is rotatable relative to the piston rod.

* * * * *